United States Patent [19]

Höfer et al.

[11] 4,092,964

[45] June 6, 1978

[54] PUMP NOZZLE FOR FUEL INJECTION IN INTERNAL COMBUSTION ENGINES

[75] Inventors: Gerald Höfer, Weissach-Flacht; Franz Eheim; Odon Kopse, both of Stuttgart, all of Germany

[73] Assignee: Robert Bosch GmbH, Stuttgart, Germany

[21] Appl. No.: 751,853

[22] Filed: Dec. 16, 1976

[30] Foreign Application Priority Data

Dec. 24, 1975 Germany ..... 2558699

[51] Int. Cl.[2] ..... F02M 39/00

[52] U.S. Cl. ..... 123/139 AT; 123/139 AK

[58] Field of Search ..... 123/139 AT, 139 BF, 123/179 L, 139 AK, 139 AP, 32 JV, 32 JT, 32 EA, 139 R, 139 AM, 140 FP; 261/76, DIG. 39; 239/289, 87; 417/499, 289, 385, 388

[56] References Cited

U.S. PATENT DOCUMENTS

| | | | |
|---|---|---|---|
| 2,940,398 | 6/1960 | Bessiere | 123/140 FP |
| 2,975,941 | 3/1961 | Claire, Jr. | 123/139 AM |
| 3,007,415 | 11/1961 | Bessiere | 123/140 FP |
| 3,752,136 | 8/1973 | Knight et al. | 123/139 AS |
| 3,782,864 | 1/1974 | Perr | 123/139 AK |
| 3,952,711 | 4/1976 | Kimberley et al. | 123/139 AT |

FOREIGN PATENT DOCUMENTS

| | | | |
|---|---|---|---|
| 938,264 | 10/1963 | United Kingdom | 123/140 FP |

*Primary Examiner*—Charles J. Myhre
*Assistant Examiner*—R. A. Nelli
*Attorney, Agent, or Firm*—Edwin E. Greigg

[57] ABSTRACT

The invention relates to improvements in a fuel injection nozzle for internal combustion engines having a mechanically driven transport piston and a coaxial slave piston slidably arranged in a cylinder, said pistons being arranged to enclose between them an equalizing chamber fed from a line carrying a low pressure fluid and with the line being closed by the boundary edge of the transport piston which faces the equalizing chamber, and more particularly to a structure wherein the fluid in said equalizing chamber as well as that in the pressure line extending to a pressure chamber arranged to receive a needle valve is controllable by means of said slave piston to terminate the fuel injection.

10 Claims, 1 Drawing Figure

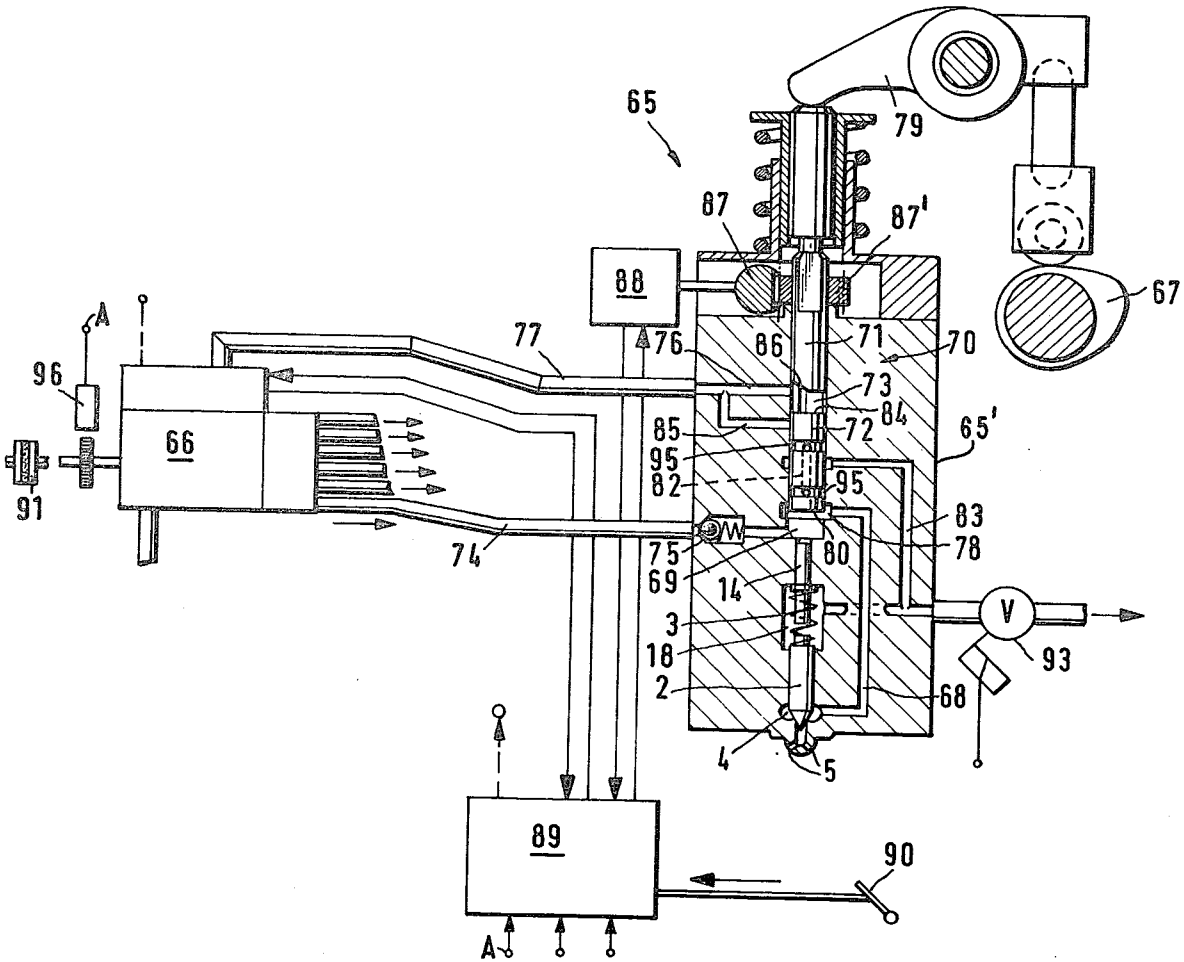
67
79
87'
70
71
73
84
72
65'
83
78
95
80
68
93
V
90
5
4
14
3
18
2
86
87
65
76
85
95
82
75
69
88
77
74
89
A
66
96
91

PUMP NOZZLE FOR FUEL INJECTION IN INTERNAL COMBUSTION ENGINES

BACKGROUND OF THE INVENTION

The invention relates to a pump nozzle for fuel injection in internal combustion engines, including a pump piston comprising two parts, namely of a mechanically driven transport piston and of a coaxial slave piston working in the same pump cylinder. The transport piston and the slave piston enclose between them an equalizing chamber to which a supply bore carries a fluid of a low pressure. The supply bore is closable, after the onset of delivery, by means of the edge of the transport piston near the equalizing chamber. The pump nozzle includes a relief bore which communicates with the pump cylinder, and which, in order to terminate the pump motion of the slave piston, is openable by means of the edge of the slave piston nearest to the equalizing chamber. A pump working chamber defined by the end of the slave piston remote from the equalizing chamber, receives a predetermined quantity of pre-loaded fuel during the pauses between injections via a filler line equipped with a check valve. A pressure line leads to the pressure chamber of the nozzle.

In a familiar pump nozzle of this kind, fuel is injected into the internal combustion engine even after the intended termination of the injection operation, as a result of the dynamic relationships within the pump working chamber. This protraction of the injection termination results in a deterioration of the exhaust gas value, quite apart from a greater fuel consumption and detrimental noise generation.

OBJECT AND SUMMARY OF THE INVENTION

Accordingly, it is the primary object of the invention to develop a pump nozzle of the kind cited above, with which a sharp fuel injection termination that remains uniform for any given revolutions per unit time, that is to say, a governed injection termination, shall be achievable, in order to avoid the cited disadvantages of the familar pump nozzle.

This objective is achieved, according to the invention, by the fact that the fuel serves as the fluid in the equalizing chamber, and that the pressure line leading to the pressure chamber of the nozzle is controllable for the fuel injection termination, by means of the slave piston.

The invention will be better understood as well as other objects and advantages thereof will become more apparent from the following detailed description of the invention taken in conjunction with the drawing.

BRIEF DESCRIPTION OF THE DRAWING

The single FIGURE illustrates a pump nozzle according to the invention.

DESCRIPTION OF THE PREFERRED EMBODIMENT

The FIGURE depicts a pump nozzle 65 having a housing 65', which is supplied with fuel from a fuel injection pump 66, and which is driven through a camshaft 67. The closure spring 3 disposed within the customary spring chamber 18 acts simultaneously upon a needle valve 2 as well as upon an intermediate piston 14. A pressure chamber 4 of the nozzle is supplied with fuel via a pressure line 68 from a pump working chamber 69 during the pressure stroke of the pump piston 70. The pump piston 70 comprises a directly driven transport piston 71 and a slave piston 72. Between the transport piston 71 and the slave piston 72, there is disposed an equalizing chamber 73 filled with fuel, which equalizing chamber 73 can be viewed as being part of the pump piston 70.

The given fuel quantity to be injected is determined by the injection pump 66, which pre-loads this quantity into the pump chamber 69 via one of the pressure lines 74 within each of which is disposed a check valve 75. Corresponding to the given pre-load quantity, the slave piston 72 travels in the direction of the transport piston 71. This movement takes place during the "suction stroke" of the pump nozzle, during which the transport piston 71 also executes a corresponding movement. In the extreme upper position of the transport piston 71, its lower surface edge then opens a supply bore 76, which leads to a chamber of a lower pressure, as illustrated, which leads to the suction chamber of the injection pump 66, via a line 77. A variation of the preload quantity delivered into the pump chamber 69 correspondingly alters the volume of the chamber 73, that is to say, fuel flows in or out via the bore 76, as illustrated in the FIGURE.

During the transport stroke of the pump nozzle 65, the transport piston 71 is moved in the direction of the slave piston 72 by means of the cam 67 and the rocker arm 79, whereby the fuel flows out of the chamber 73 via the bore 76 until such time as the bore 76 is closed. Subsequent thereto, the slave piston 72 is displaced by means of the enclosed volume of the chamber 73 and in turn expels, from the pump chamber 69 via the pressure line 68 and into the pressure chamber 4 of the nozzle, the fuel to be injected, from which pressure chamber 4 the fuel then reaches the engine via injection openings 5 after the lifting of the needle valve 2. The injection termination is produced as a result of the fact that the lower surface 80 of the slave piston closes the entrance into an annular groove 78 of the pressure line 68. The fuel expelled from the pump working chamber 69 during the further continuation of the transport stroke of the pump piston 70 acts upon the intermediate piston 14 and pushes it in opposition to the force of the closure spring 3 against the needle valve 2. This achieves the creation of an extraordinarily high closure pressure. As the pressure line 68 is closed by means of the slave piston 72, the pressure line 68 is connected with a relief line 83 via the annular grooves 95 and the bore 82 located in the slave piston 72. By this means, the pressure in the pressure chamber 4 of the nozzle is reduced, in order to obtain a sharp closure termination. Toward the end of the transport stroke of the slave piston 72, the upper surface edge 84 of this piston 72 opens a relief bore 85, which is connected with a line 77. Hence the transport piston 71 can continue its transport stroke, and fuel flows from the chamber 73 via the bore 85, where as the slave piston 72 remains in this closure position. Only when the pump piston 70 begins its return stroke by means of the cam 67, can the intermediate piston 14 also move back to its initial position. However, this time point will always be chosen such that it will be impossible to press the needle valve 2 open either from the engine chamber or from the pressure chamber 4.

In order to achieve a possibly necessary adjustment of the injection time point, the lower surface terminal edge 86 of the transport piston 71 is provided with a beveled or diagonal portion, control portion, as shown, and the transport piston 71 is rotatable by means of a mechanism, for example a gear rack 87. By this means, it is possible that the bore 76 may be closed at different times in accordance with the given rotational position of the transport piston 71, so that the operation of the slave piston 72 can take place at a different point in time. The adjustment of the mechanism 87 can be accomplished by a drive motor 88, which is controlled by an electrical control apparatus 89. The control apparatus 89 can simultaneously serve for the regulation of the fuel injection pump 66. The control apparatus 89 can even comprise an integral regulator of the fuel injection pump 66. The given load data would thus be fed to this control apparatus 89 via the accelerator pedal 90, whereas the revolutions per unit time are fed to the control apparatus 89 via the coupling 91 of the fuel injection pump 66 and via a revolutions counter 96 by means of the connections A—A. A supplementary modulation of the fuel injection equation can take place via the return check valve 93, which is located in the relief line 83, and with which return check valve 93 the pressure in the spring chamber 18, and thereby the opening stroke of the needle valve 2, are controlled. The pressure control valve 93 can likewise be controlled by the control apparatus 89.

What is claimed is:

1. A fuel pump nozzle for injecting fuel into an internal combustion engine, comprising:

a housing within which a pump cylinder, a spring chamber, a pressure chamber, a working chamber, and an equalizing chamber are defined;

a transport piston;

a slave piston, said transport piston and said slave piston being coaxially disposed within the pump cylinder, and defining the equalizing chamber with the pump cylinder, said slave piston also defining the working chamber with the pump cylinder, said transport piston defining a control portion formed as part of its terminal edge facing the equalizing chamber;

mechanical means engageable with the transport piston for mechanically driving the transport piston;

means defining a supply bore connected to the housing for supplying a low pressure fluid to the equalizing chamber, said supply bore being closeable by the control portion of the transport piston terminal edge;

means defining a relief bore connected to the housing for relieving the pressure in the equalizing chamber under the control of the slave piston;

means defining a pre-load fuel quantity line connected to the housing for delivering a pre-load fuel quantity to the working chamber;

a check valve located in the pre-load fuel quantity line, opening in the direction of fuel flow; and means defining a pressure line connecting the working chamber and the pressure chamber, wherein:

(i) fuel serves as the fluid delivered to the equalizing chamber by the supply bore; and (ii) the pre-load fuel quantity is delivered to the pressure chamber through the pressure line by the slave piston.

2. The fuel pump nozzle as defined in claim 1, further comprosing:

means connected to the transport piston for rotating said transport piston, wherein the control portion of the transport piston forms a diagonal control edge for controlling the supply bore, according to which the pumping start and the start of fuel injection are varied.

3. In a fuel injection nozzle as claimed in claim 2, in which said transport piston is rotated through means dependent on the function characteristics and operation of the internal combustion engine.

4. In a fuel injection nozzle as claimed in claim 3, in which said transport piston is rotated by rack and gear means.

5. In a fuel injection nozzle as claimed in claim 4, in which said gear means is associated with said transport piston and said rack is associated with said housing.

6. The fuel pump nozzle as defined in claim 1, further comprising:

means defining a further relief line connectable with the pressure chamber and the spring chamber by the slave piston, said spring chamber having a lower pressure prevailing therein than said pressure chamber.

7. The fuel pump nozzle as defined in claim 6, further comprising:

a short circuit line defined within the slave piston having terminal ends opening on the surface of said slave piston, wherein the pressure line and further relief line each terminate in the pump cylinder and are controlled by an edge of the slave piston facing the working chamber, and wherein the terminal ends of the short circuit line are connected with the terminal ends of the pressure line and the further relief line, respectively, when the pre-load fuel quantity has been delivered from the working chamber.

8. The fuel pump nozzle as defined in claim 7, wherein the terminal ends of the short circuit line, the pressure line and further relief line are formed at annular grooves.

9. The fuel pump nozzle as defined in claim 1, further comprising:

a pressure valve connected to the further relief line for controlling the pressure in the further relief line in accordance with the load and rpm on the engine.

10. In a fuel injection nozzle as claimed in claim 1, in which said fluid pressure to said cylinder is pre-loaded and apportioned by a fuel injection pump.

* * * * *